US006053657A

United States Patent [19]

Signorelli

[11] Patent Number: 6,053,657

[45] Date of Patent: Apr. 25, 2000

[54] PORTABLE SAFETY MARKER

[75] Inventor: John A. Signorelli, Brooklyn, N.Y.

[73] Assignee: Consolidated Edison Company of New York, Inc., New York, N.Y.

[21] Appl. No.: 08/992,990

[22] Filed: Dec. 18, 1997

[51] Int. Cl.[7] ..... E01F 13/00; E01F 9/00; B63B 22/00

[52] U.S. Cl. ..... 404/6; 404/9; 116/63 C; 441/6

[58] Field of Search ..... 404/6, 9; 116/63 C, 116/63 P; 242/376; 226/139; 441/6; D10/113

[56] References Cited

U.S. PATENT DOCUMENTS

| | | | |
|---|---|---|---|
| D. 400,814 | 11/1998 | Sheng | D10/113 |
| 2,834,314 | 5/1958 | Moore | 116/63 |
| 2,997,978 | 8/1961 | Clutter | 116/63 |
| 3,223,387 | 12/1965 | Magliocco | 256/1 |
| 3,520,235 | 7/1970 | Palazzolo et al. | 94/1.5 |
| 3,782,322 | 1/1974 | Wilson | 116/63 P |
| 3,809,007 | 5/1974 | Brown | 116/63 P |
| 3,917,231 | 11/1975 | Fink | 256/64 |
| 4,124,196 | 11/1978 | Hipskind | 256/1 |
| 4,197,808 | 4/1980 | Kinninger | 116/63 C |
| 4,466,376 | 8/1984 | Wells | 116/63 P |
| 4,533,122 | 8/1985 | Bannister | 256/69 |
| 4,772,869 | 9/1988 | Grammas et al. | 340/114 B |
| 4,798,747 | 1/1989 | Laramee | 428/12 |
| 4,844,420 | 7/1989 | Oster | 256/1 |
| 4,925,334 | 5/1990 | Beard | 404/9 |
| 4,936,804 | 6/1990 | Dowdeswell | 441/6 |
| 5,030,029 | 7/1991 | Johnsen | 404/6 |
| 5,090,349 | 2/1992 | Wilson | 116/63 |
| 5,269,251 | 12/1993 | Freeman | 116/63 C |
| 5,350,330 | 9/1994 | Platis | 441/6 |
| 5,421,668 | 6/1995 | Cowan et al. | 404/6 |
| 5,501,429 | 3/1996 | Sakuma | 256/1 |
| 5,722,611 | 3/1998 | Schmidt et al. | 242/376 |
| 5,722,788 | 3/1998 | Bent et al. | 404/6 |

*Primary Examiner*—Eileen Dunn Lillis
*Assistant Examiner*—Raymond W Addie
*Attorney, Agent, or Firm*—Kramer Levin Naftalis & Frankel LLP

[57] ABSTRACT

A safety or traffic marker is capable of providing a continuous physical border between two locations. A housing, or one of several adapters, are employed in a conventional traffic cone to dispense an elongated strip of tape therefrom. In one embodiment, the housing is physically incorporated into the interior of the marker, and is adapted for easy insertion and removal of a tape or safety material dispenser. In order to achieve easy insertion of the tape dispenser into the housing, the upper portion of the marker is split into separable sections. Since the marker is fabricated from a deformable material, the upper portion can be manually separated into an opened position for insertion of the tape dispenser therein. Hook and loop fasteners may be used to fasten together the two sections into a closed position. Adapters may also be used in conjunction with conventional traffic markers for creating a continuous physical border between two or more locations.

39 Claims, 13 Drawing Sheets

PORTABLE SAFETY MARKER

BACKGROUND OF THE INVENTION

1. Technical Field

The present invention generally relates to markers used to alert and divert vehicles, watercraft, aircraft and pedestrians to pass safely around hazards or other obstacles. More particularly, the present invention relates to safety markers and marker adapters which are capable, for example, of dispensing a safety material therefrom for providing a continuous physical border between two or more locations.

2. Background Information

The control and diversion of the flow of pedestrian and vehicular type traffic flow around temporary road hazards and other conditions may be handled through the use of portable traffic markers, e.g., traffic cones or pylons. For example, when a manhole cover on a roadway is removed therefrom, the danger area, i.e., the area surrounding the open manhole, may be barricaded with one or more portable traffic markers.

The conventional traffic cone or marker is hollow, includes base and upper portions, wherein an opening extends through the top of the upper portion into a hollow interior. These cones are usually fabricated from a rubber-based or some other elastomeric material. Such markers usually take a conical or cylindrical shape and are constructed of brightly colored, e.g., orange, and relatively lightweight resilient materials. Reflective materials may also be used to improve their visibility. As such, they have become universally accepted as an effective means for controlling the flow of pedestrian and vehicular traffic. These markers are highly visible, and can be easily and readily positioned on a ground surface. Often, a row or string of markers, i.e., spaced apart from one another, are employed to alert and divert all forms of traffic around or away from the hazard or obstacle.

One drawback associated with conventional traffic cones is that they are freestanding static objects, without adequate means for being connected together. Therefore, the creation of an imaginary line or border to delineate the area surrounding the obstacle or hazard is usually attempted by simply arranging a plurality of cones in spaced apart relation. Under such an arrangement, it is desired that pedestrians and vehicles will not pass through the imaginary border created by the string of cones. Nonetheless, pedestrians and vehicles still tend to pass through adjacently placed cones, unknowingly or knowingly risking injury to themselves and others, such as utility workers.

In order to create a visible physical border between adjacent or neighboring cones and structures, and therefore to avoid the problem of traffic passing through the imaginary border as described above, tape or rope is at times employed to connect the cones together, or to connect one or more cones to some structure such as a lamp post. However, tape and rope tend to become easily unfastened and/or slip off, especially under poor weather conditions. Moreover, the conical shape and smoothness of the markers, together with their failure to have adequate means of fastening, facilitates the difficulty of using tape and rope. Therefore, tape and rope are generally unreliable for creating a good physical border between cones and other objects. In addition, tape and rope are both relatively thin, and are not easily visible, especially at night or in poor weather conditions. Finally, rolls of tape and rope are often forgotten by the utility workers due to the cones not having the facilities for securely fastening the safety material thereto.

Another problem associated with conventional traffic cones is the ease at which they can be tipped or knocked over. This is the result of the markers being relatively light and also because the base design has minimal surface area contact with the ground surface. The underside of the markers typically have protruding legs or ribs which contact the ground. This results in reduced surface friction and the possibility of being easily moved or knocked over by unintentional forces such as strong winds, e.g., large truck tail winds. Other forces, such as a pedestrian simply brushing a cone while passing, often causes tipping. One past solution to this problem has been to employ nails or spikes to affix the marker to finished ground surfaces, such as street covered asphalt. However, this has the undesirable result of causing damage to the ground surface and/or marker. Additional solutions include ring weights that may be placed over the body of the cone. However, ring weights are generally not desirable due to difficulty in handling and because of the need for significant storage facilities.

Thus, a need exists for a safety marker which does not suffer from the above-stated drawbacks. More specifically, there is a need for a safety marker that can be employed to easily and reliably form a continuous physical border for a specified area. The structure of the present invention contains a solution to the aforementioned problems. As defined below, the present invention provides a significant improvement over currently existing cones and other marker equipment used to delineate an area for providing safety and direction.

SUMMARY OF THE INVENTION

Briefly, the present invention satisfies this need and overcomes the shortcomings of the prior art through the provision of a new and unique portable traffic safety marker for delineating obstacles and the like. The subject invention provides an effective means for creating a continuous physical border between two or more traffic markers, and between one or more markers and one or more other objects. The portable marker of the present invention includes a base portion and an upper portion. The base portion is configured for facilitating upright placement of the marker on a road or other surface. A sidewall extends upwardly from the base portion to the upper portion, wherein the sidewall has an inner surface and an outer surface. A hollow interior is defined in part by the inner surface of the sidewall, and a tape dispensing housing is disposed inside the hollow interior. The housing is adapted for receiving a tape dispenser therein and for dispensing an elongated strip of tape or safety material therefrom. An opening is formed through the sidewall for dispensing the elongated strip of tape therethrough. The upper portion of the marker is preferably divided into two separable sections. The two sections are easily spread apart so that the tape dispenser can be easily inserted therein. Also, in the event that a new tape dispenser is needed, the two sections can be manually spread to the opened position, where the old dispenser can be removed and replaced with a new dispenser. During operation, the two sections of the upper portion of the marker are maintained in a closed position, with, for example, hook and loop fasteners. Additionally, in lieu of or in conjunction with a tape dispenser, a sign can be inserted through the apertures.

In another embodiment of the invention, there are three adapters which may be employed with conventional traffic markers for creating a continuous physical border between two markers: a ring or doughnut adapter which is slidably received by the upper portion of a traffic cone; a cone shaped adapter which is slidably inserted onto the upper portion of a traffic cone; and a rod adapter which is inserted into the vertically disposed top hole of a traffic cone. Each one of these adapters can be used with conventional traffic cones in order to dispense, for example, a roll of safety tape therefrom for creating a continuous physical border.

BRIEF DESCRIPTION OF THE DRAWINGS

The subject matter which is regarded as the present invention is particularly pointed out and distinctly claimed in the concluding portion of the specification. The invention, however, both as to organization and method of practice, may be best understood by reference to the detailed description, taken in conjunction with the accompanying drawings, in which:

DETAILED DESCRIPTION

Figure 1:
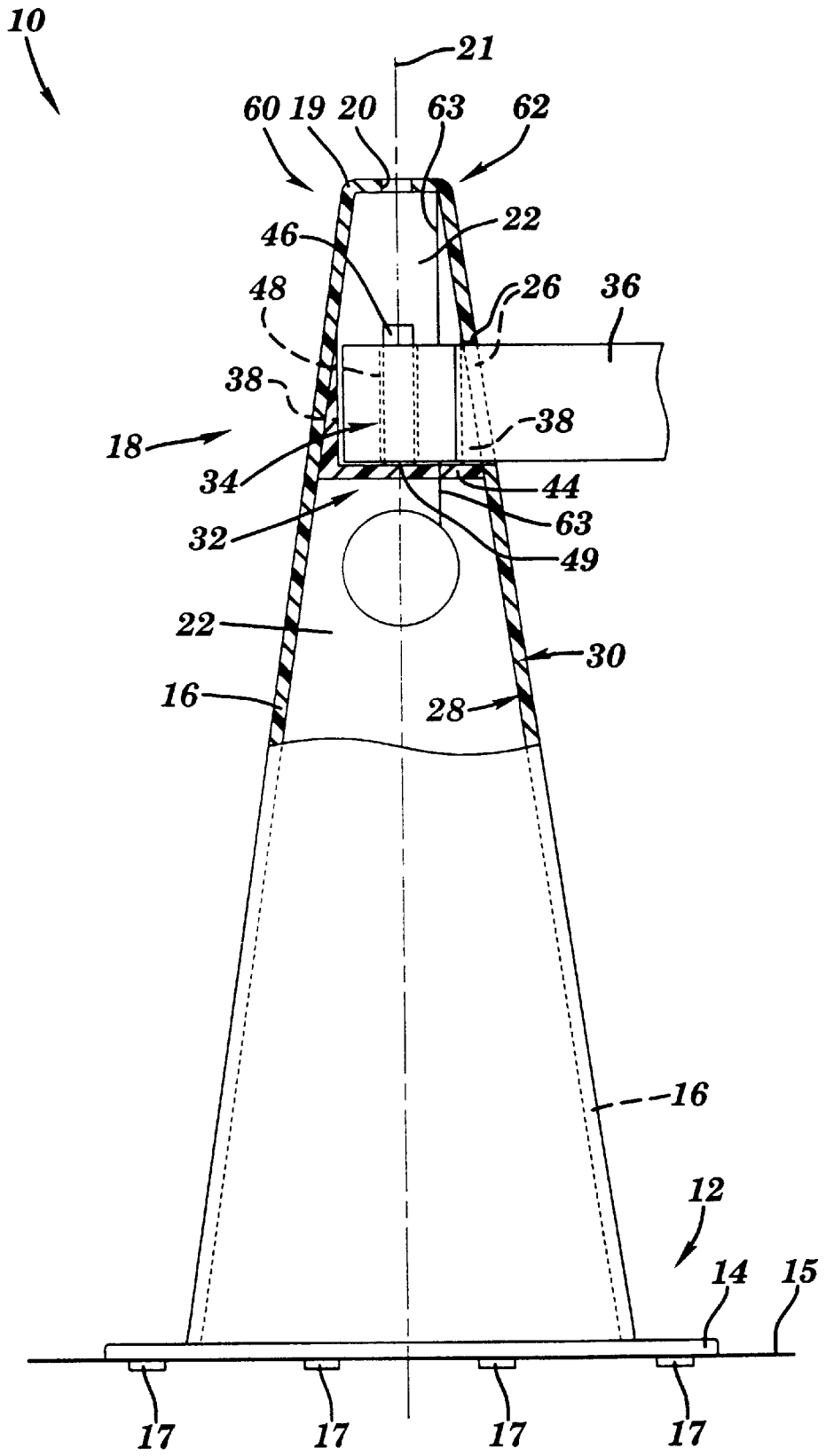
FIG. 1 is a side view of a safety marker, partially in cross-section, illustrating one aspect of a tape dispensing housing constructed in accordance with the principles of the present invention.

It will be readily apparent that the components of the present invention, as generally described and illustrated in the drawings, could be arranged and designed in a wide variety of different configurations. Thus, the following detailed description of the presently preferred embodiments of the portable safety or traffic marker of the present invention, as represented in FIGS. 1–15, is not intended to limit the scope of the invention, as claimed, but is merely representative of the presently preferred embodiments of the invention. The presently preferred embodiments of the invention will be best understood by reference to the drawings, where like parts are designated with like numerals.

As illustrated in FIG. 1, there is shown one embodiment of a portable safety or traffic marker 10, constructed in accordance with the principles of the present invention. Like a conventional traffic cone, marker 10 includes a lower portion 12, having a generally flat base 14 extending outwardly therefrom, and an upper portion 18, having a truncated and flat top 19. Base 14 is configured for stabilizing and maintaining marker 10 on a surface 15, such as a dirt roadway, and therefore, may include surface engaging ribs 17 on its underside. A conical sidewall 16 tapers upwardly from base 14, terminating at the top 19 of the marker 10. A vertical aperture 20 is formed through the top 19 into a hollow interior 22. Sidewall 16 includes an inner surface 28 and an outer surface 30, and hollow interior 22 is defined, at least in part, by inner surface 28 of marker 10. A housing 32 is disposed inside hollow interior 22, and is adapted for receiving a tape dispenser 34 therein for dispensing safety indicator material, e.g., an elongated strip of tape 36 through an opening 26 formed in sidewall 16.

Housing 32 includes a flat bottom wall 44, which can be formed integral to or otherwise secured to sidewall 16. Extending upward from bottom wall 44 is a cylindrical wall 38. An interior of housing 32, defined by the inner surface of cylindrical wall 38, is cylindrical in shape and mimics the cylindrical shape of a cartridge or tape dispenser 34. Like flat bottom wall 44, cylindrical wall 38 can be formed integral to or otherwise secured to sidewall 16. A pin or rod 46, preferably cylindrical in shape, extends upwardly from bottom wall 44 in a direction parallel to a central axis 21 of aperture 20. Rod 46 is configured for receiving an aperture 48 of tape dispenser 34.

Tape dispenser 34, as used throughout this specification, is meant to connote any means for dispensing an elongated strip of tape 36 or likewise material therefrom. Also, the term "tape" as used herein is intended to include any form of safety indicator material, including, for instance, rope. In one sense, tape dispenser 34 can comprise a roll of tape or fabric material wrapped around a tubular ring having a central core formed therethrough. Therefore, as shown in FIG. 1, pin or rod 46 acts as a receiving means for aperture 48 so that the tape 36 can be easily dispensed. During operation, the tape is easily dispensed by rotating tape dispenser 34 about rod 46. Another configuration for a tape dispenser is a roll of tape wrapped around a solid rod, wherein the ends of the rod extend outwardly beyond the edges of the roll of tape, which can also be used in the present invention (see FIG. 3 and accompanying text).

Preferably, the lower end of rod 46 is pivotally connected to bottom wall 44 so that rod 46 can be bendably moved about a pivot point 49. This "joystick" configuration permits rod 46 to be pivoted about pivot point 49 into any number of different orientations, which in turn, facilitates the easy and quick insertion of aperture 48 of tape dispenser 34 into rod 46.

Figure 2:
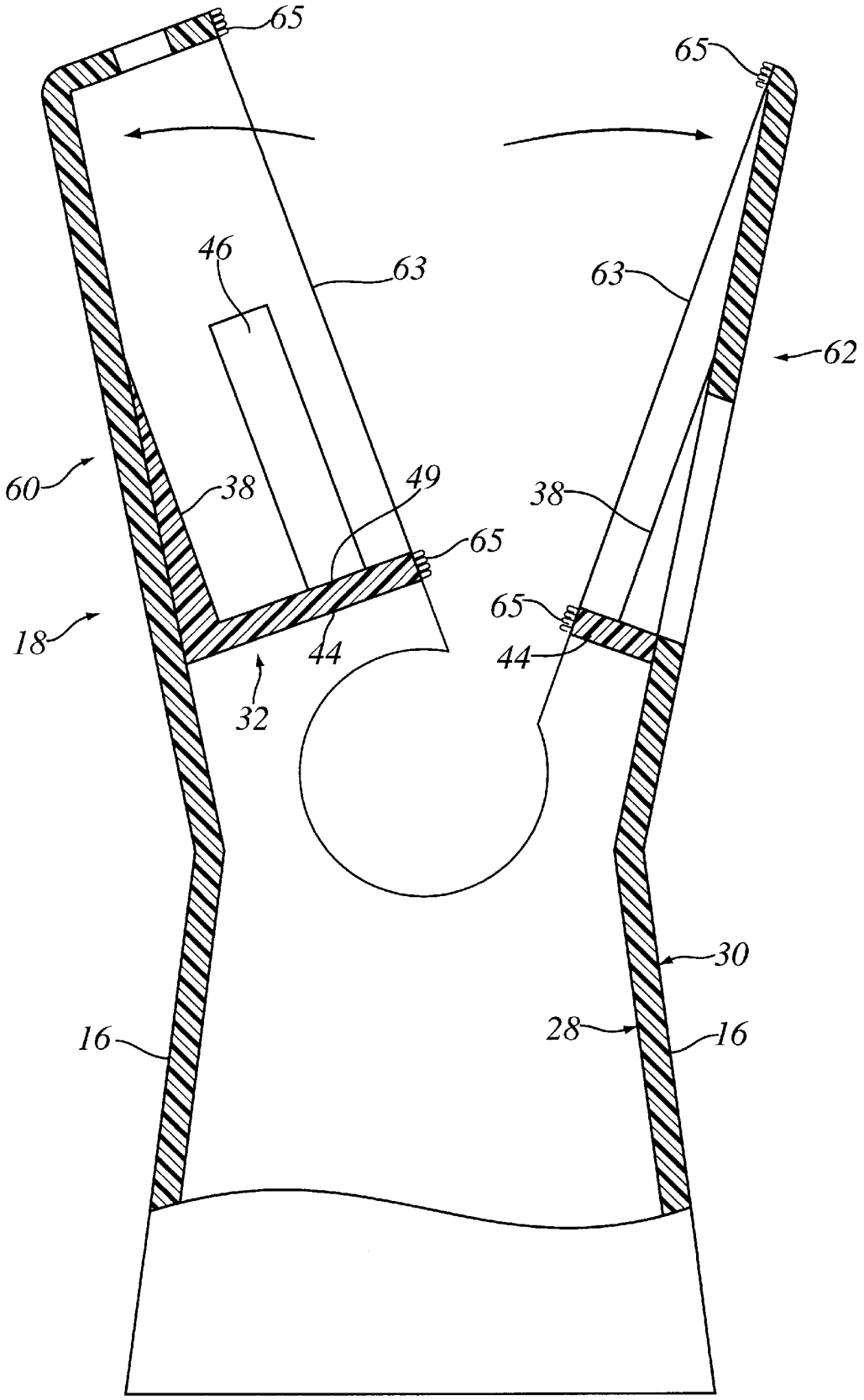
FIG. 2 is a partial side view, in cross section, of an upper portion of the safety marker of FIG. 1, wherein the upper portion is shown separated into two sections.

In order to accommodate the insertion of tape dispenser 34 into housing 32, upper portion 18 of marker 10, including housing 32, is formed or divided into two manually separable sections, a first section 60 and a second section 62. As shown in FIGS. 1 & 2, an incision or cut 63 in marker 10 and housing 32 defines first section 60 from second section 62. Cut 63 extends vertically downward from the top 19 of marker 10, and terminates a sufficient distance down the body of marker 10 so that first and second sections 60, 62 can be easily separated for inserting tape dispenser 34 into the interior of housing 32.

It should be noted that traffic marker 10 is preferably constructed of a rubber-based or elastomeric material which is sufficiently deformable and resilient so that upper portion 18 can be separated as described herein.

By defining upper portion 18 of marker 10 into two separable sections, upper portion 18 of marker 10 can be manually positioned into a closed position (FIG. 1) or into an opened position (FIG. 2). When a dispenser 34 needs to be inserted into housing 32, by simply grasping sections 60, 62, and pulling outwardly, upper portion 18 of marker 10 can be opened, so that the old dispenser 34 can be removed, and a new tape dispenser, having a fresh roll of tape, can be easily and readily inserted into housing 32. The new safety dispenser 34 may have a differently designed or colored tape. In addition, such tape may include written words, such as "caution," "danger," etc. The rolls of tape may be relatively small in diameter, e.g., on the order of 1 to 2 inches, and can include approximately 25 feet or more of safety material.

Figure 2A:
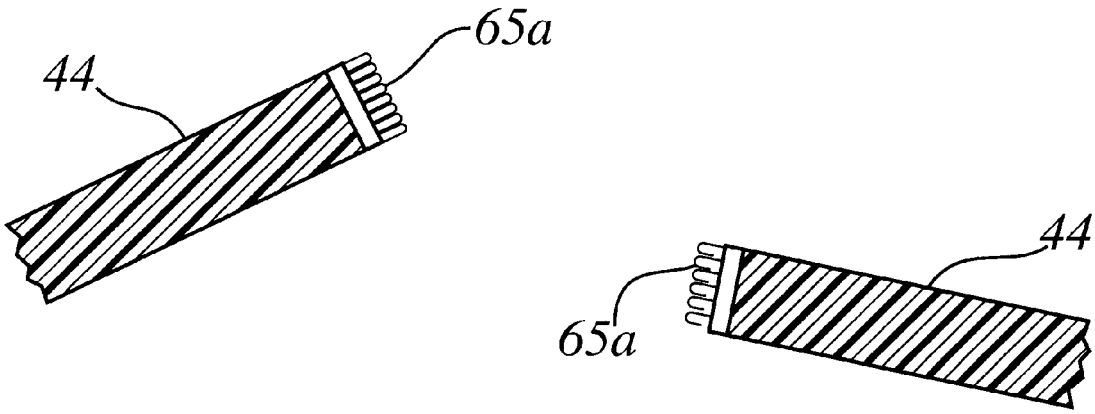
FIG. 2A is a fragmentary view of an alternative embodiment of FIG. 2 wherein the means for removably securing the two sections together comprise latching fasteners.
Figure 2B:
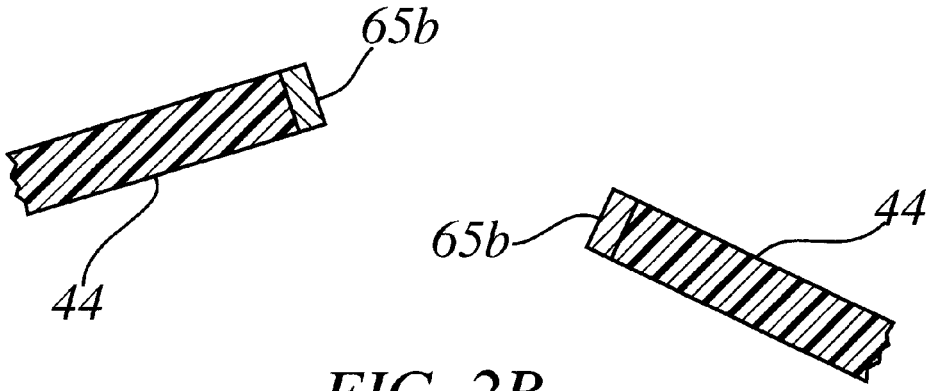
FIG. 2B is a fragmentary view of an alternate embodiment of FIG. 2 wherein the means for removably securing the two sections together comprise magnets.

In order to keep first and second sections 60, 62 in the closed position (FIG. 1), marker 10 may include means for removably securing the two sections together. For example, hook and loop fasteners 65 (FIG. 2), attached correspondingly to the interface of sections 60, 62, can achieve an easily detachable, but reliable bond for maintaining upper portion 18 in the closed position. In lieu thereof, however, suitable alternate means include latching fasteners 65*a* (FIG. 2A) flush mounted solid magnets 65*b* (FIG. 2B), integral granual magnets and gel-based adhesives.

Figure 3:
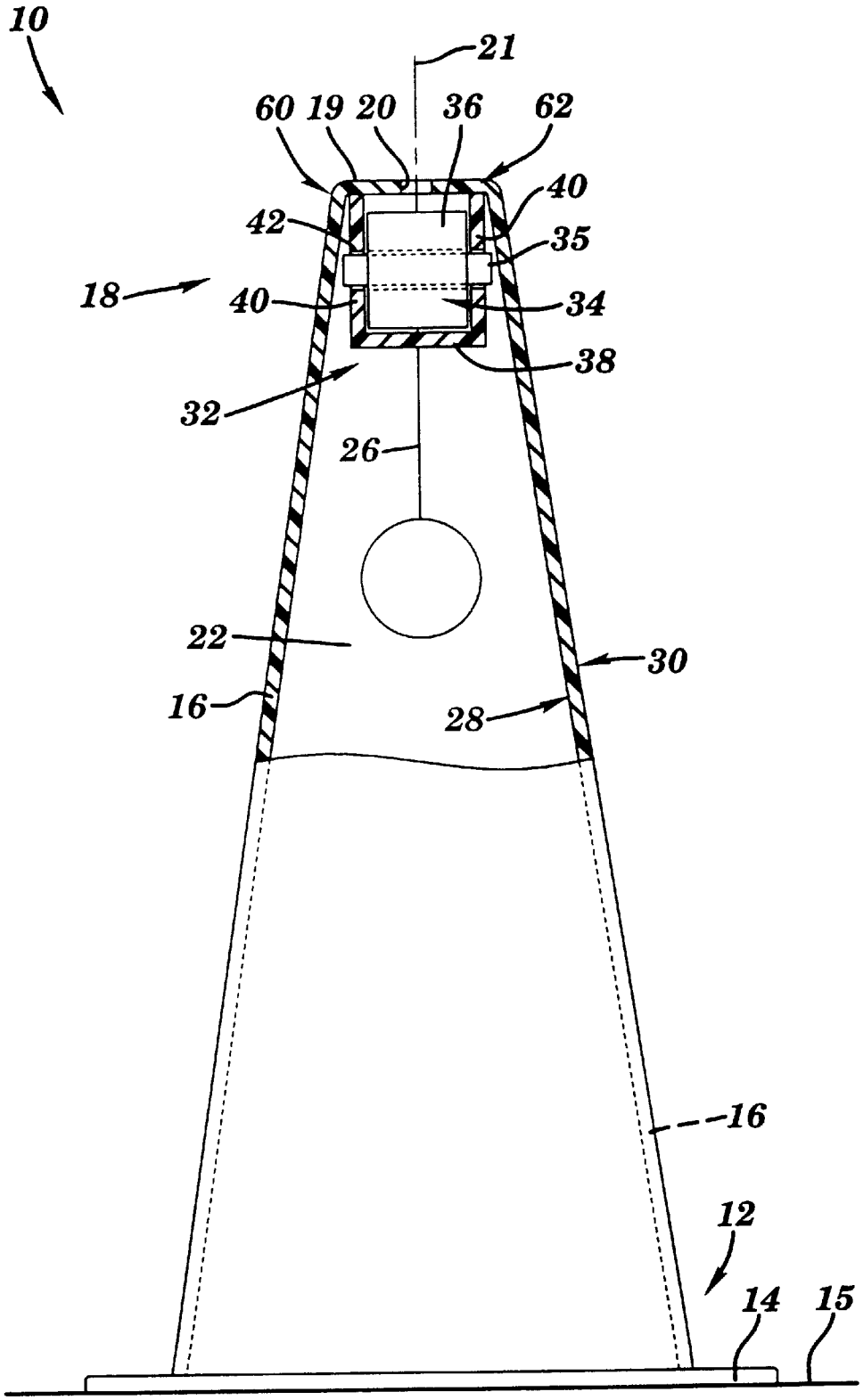
FIG. 3 is a side view of a safety marker, partially in cross-section, illustrating another aspect of a tape dispensing housing constructed in accordance with the principles of the present invention.

In another aspect of the invention, as illustrated in FIG. 3, housing 32 can be rearranged such that the cylindrical wall 38, instead of being disposed as a sidewall as shown in FIG. 1, may be rotated 90 degrees, thus being disposed as a bottom wall. Therefore, two lateral end walls 40, oriented parallel to one another, depend downwardly from the underside of top 19 of marker 10. An aperture 42 is formed in each end wall 40 of housing 32 for receiving an end of a rod 35 of tape dispenser 34. During operation, rod 35 rotates within apertures 42.

Like marker 10 illustrated in FIGS. 1 & 2, the marker of FIG. 3 is divided into two separate sections, a first section 60 and a second section 62, so that upper portion 18 can be opened and closed for the insertion and removal of tape dispenser 34. In this configuration, the width of elongated strip of tape 36 is unrolled or dispensed parallel to surface 15. Therefore, in order for the strip of tape 36 to pass through the vertical opening 26 as shown in FIG. 3, the strip of tape 36 would be rotated 90 degrees.

Figure 4:
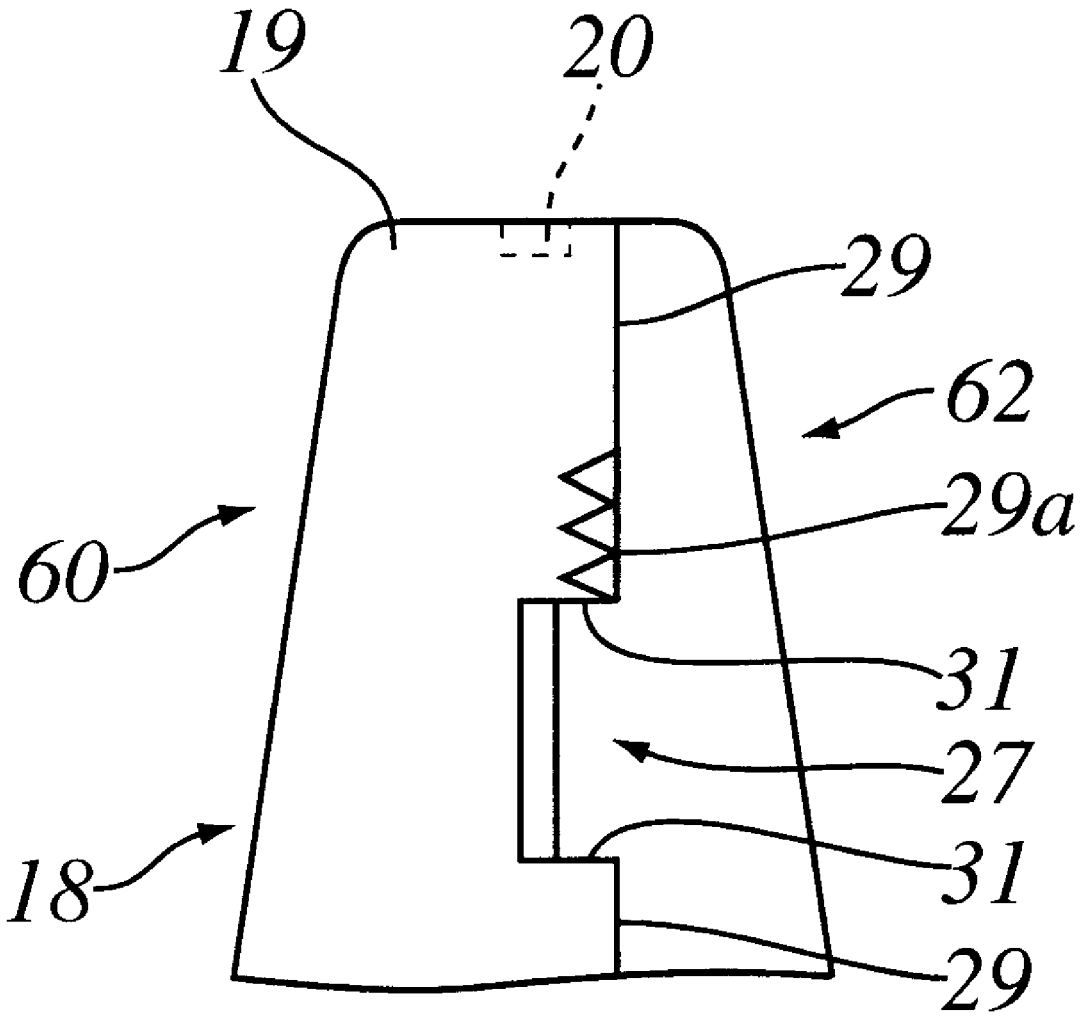
FIG. 4 is a partial blown-up side view of an upper portion of a traffic marker of the subject invention, illustrating one embodiment of an opening for dispensing tape therethrough.

FIG. 4 illustrates upper portion 18 of marker 10 having a slot opening 27 for the strip of tape to pass through. Slot opening 27 includes a part of a cut or slit 29, which splits upper portion 18 of marker 10 into two sections 60, 62. Instead of a straight vertical slit, FIG. 4 illustrates an offset slit, wherein slit 29 includes two horizontal segments 31 and a jagged slit 29*a*. Offsetting the slit in this fashion facilitates the proper positioning of tape 36 as it is dispensed from housing 34. The two horizontal segments 31 also prevent the safety material from slipping or sliding out of marker 10. While slot opening 27, as illustrated in FIG. 4, is an open rectangular area, in lieu thereof, the walls of the opening can be contiguous to one another. Such a configuration facilitates the holding of the tape therein by the gripping forces of the contiguous opening.

Figure 5:
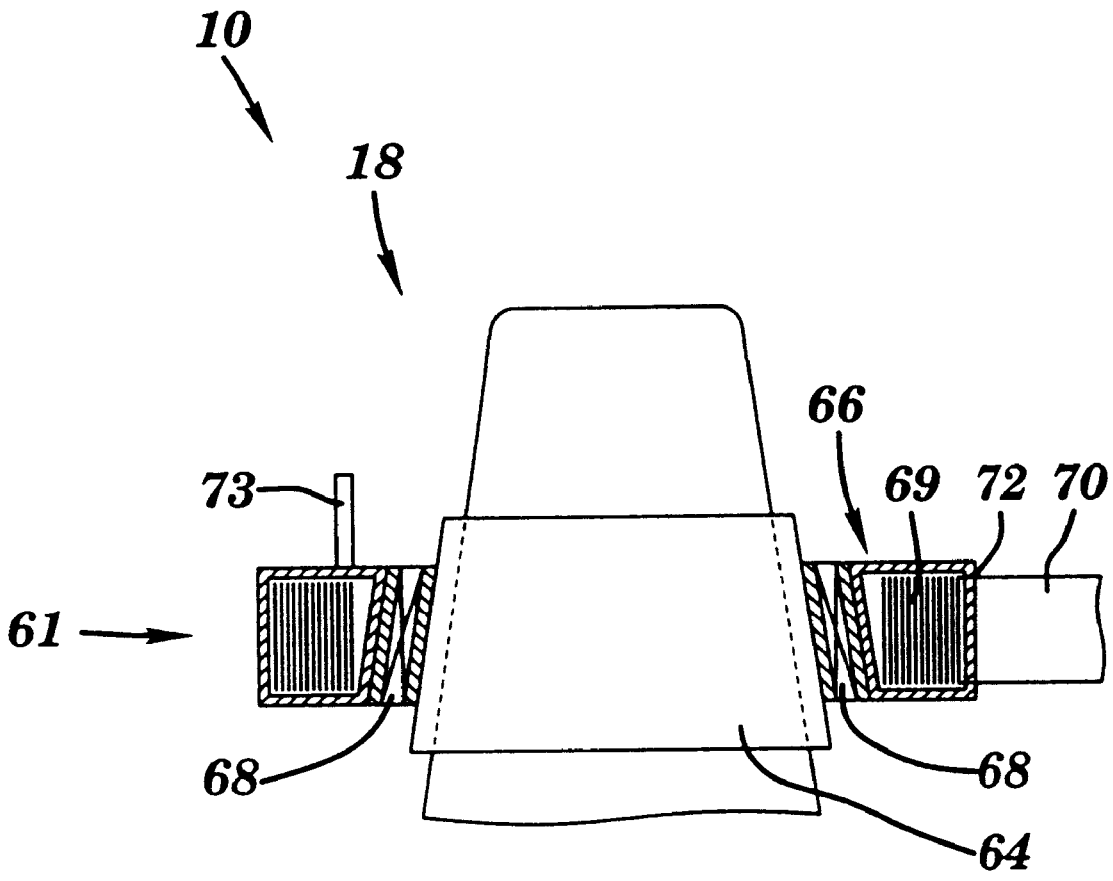
FIG. 5 is a side view of another embodiment of the subject invention, illustrating a "doughnut" adapter slidably engaged onto the upper portion of a conical traffic marker.

In another aspect of the present invention, as illustrated in FIG. 5, a ring or "doughnut" adapter 61 may be used for attachment to a conventional traffic marker, or to one of the traffic markers described herein, for dispensing an elongated strip of tape to create a continuous physical border. Adapter 61 includes an inner member 64 and an outer member 66, wherein the outer member 66 is rotatable relative to inner member 64.

Inner member 64 has a central tapered core which is configured for slidable insertion onto upper portion 18 of marker 10. By slidably inserting adapter 61 onto upper portion 18 of marker 10, a friction fit can be created so that adapter 61 is removably, but fixedly, secured thereto.

Outer member 66 includes a cavity 69 for retaining an elongated strip of tape 70 therein. An opening 72 extends through outer member 66 for dispensing tape 70 therefrom.

Outer member 66 and inner member 64 are configured for relative rotational movement, so that the location of opening 72 can be variably adjusted about the periphery of marker 10. Any known means may be employed in moving outer member 66 in relation to inner member 64, e.g., a plurality of ball bearings 68. Other equally satisfactory means which may substituted therefor include encased lubricants and gels, and metal tracts.

Preferably, adapter 61 includes means for rewinding elongated strip of tape 70. Any known mechanical means may be employed in rewinding or retracting tape 70 within cavity 69, such as a spring actuated mechanism. A winding handle 73 may be employed for rewinding. In addition, any known means for locking outer member 66 in relation to inner member 62 can be employed in adapter 61. It is noted that by employing adapter 61, safety tape can be dispensed from both a tape dispenser in the marker and from the adapter.

Figure 6:
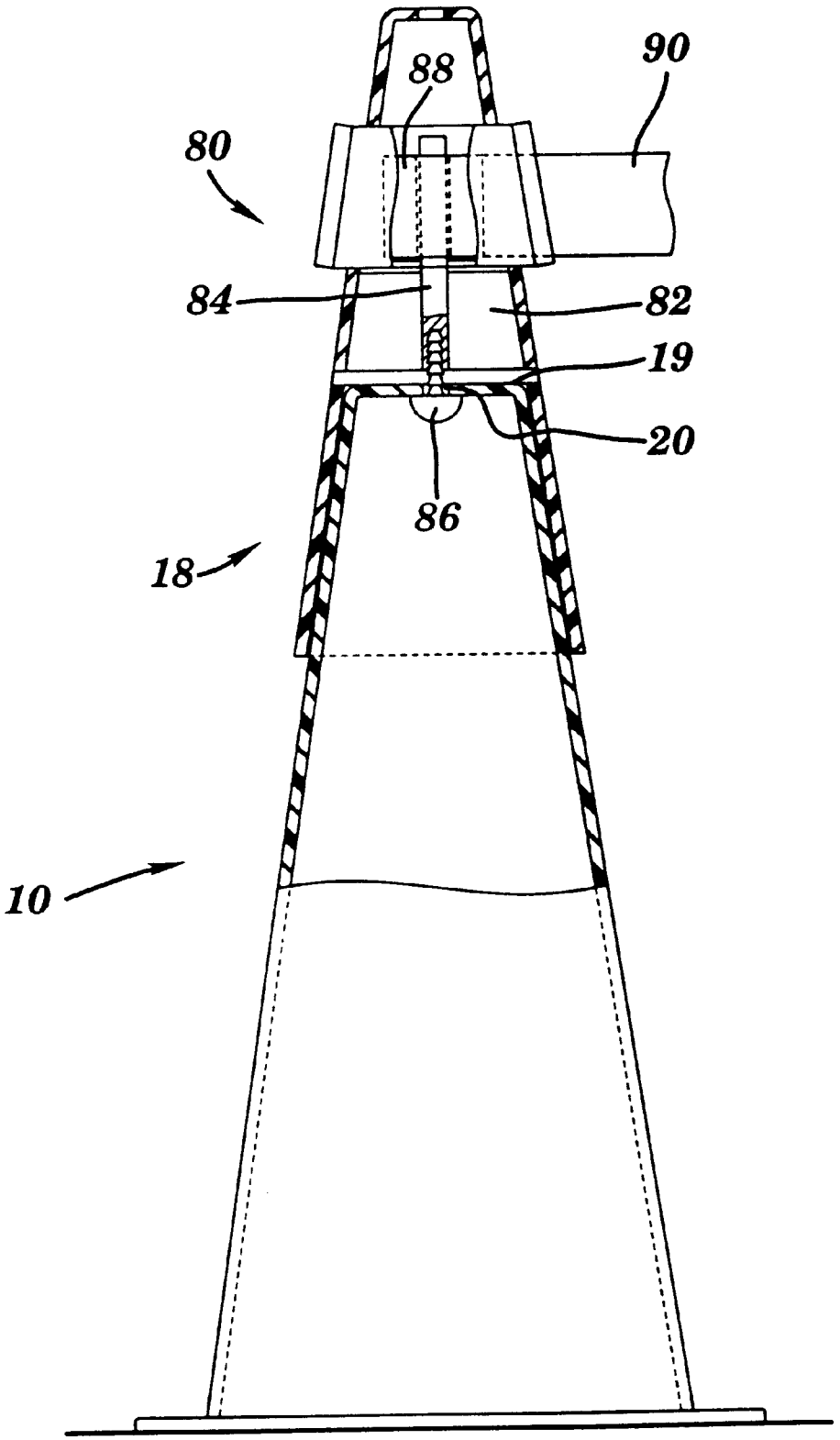
FIG. 6 is a side view of another embodiment of the subject invention, illustrating a cone adapter which is placed on top of a conical traffic marker, wherein the cone adapter includes means for dispensing an elongated strip of tape housed therein, wherein the elongated strip of tape can be easily dispensed and retracted therefrom.
Figure 7:
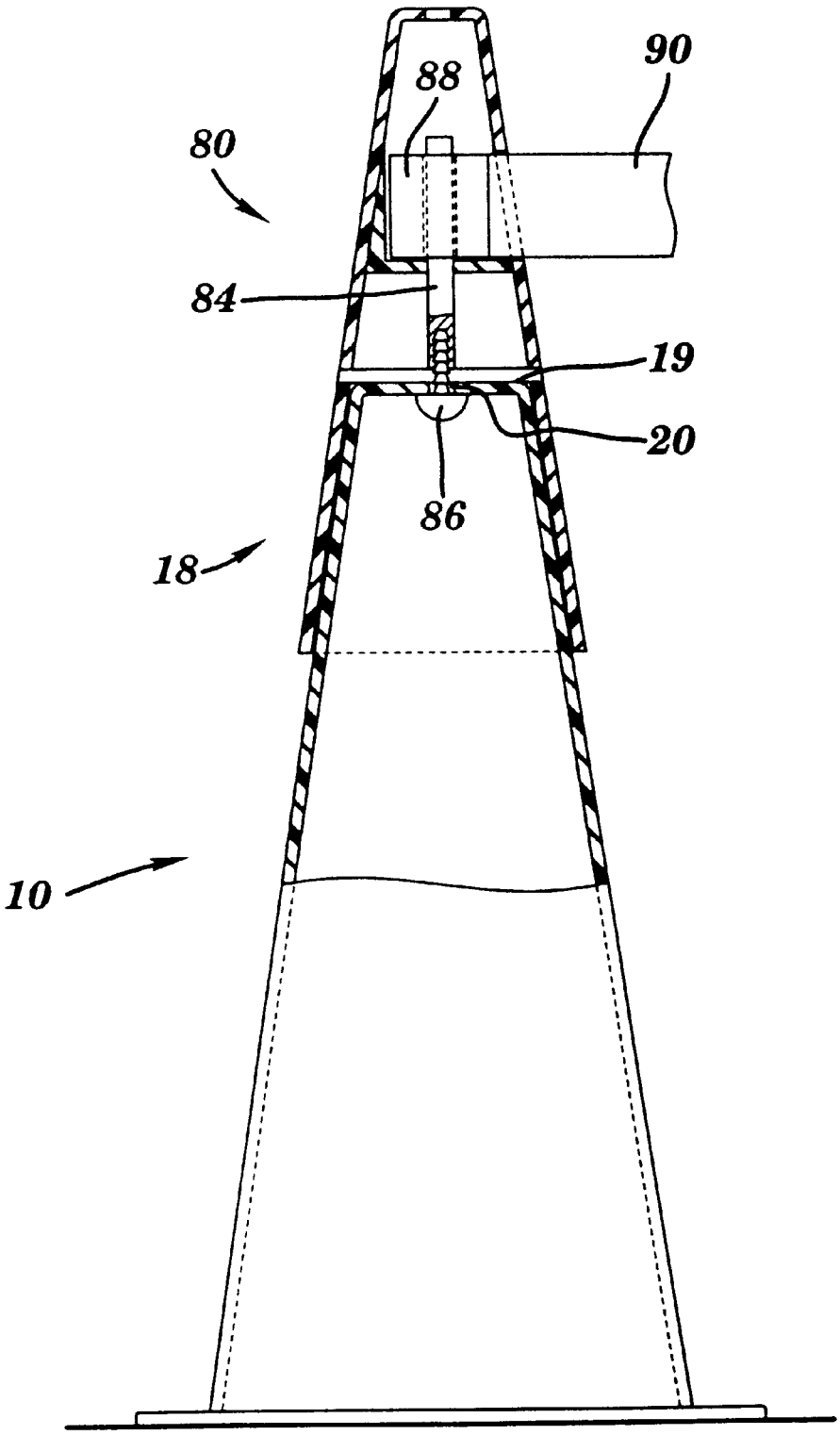
FIG. 7 is a side view of the adapter cone of FIG. 6, but with the tape dispenser disposed inside of the upper portion of the adapter.

FIGS. 6 & 7 depict another aspect of the present invention, i.e., a cone adapter 80, which can be used for attachment to a conventional traffic marker, or to one of the traffic markers described herein, for dispensing an elongated strip of tape to create a continuous physical border between two or more locations. Like doughnut adapter 61, cone adapter 80 may be slidably inserted onto upper portion 18 of marker 10. By slidably inserting adapter 80 onto upper portion 18 of marker 10, a friction fit can be created so that adapter 80 is removably, but fixedly, secured thereto. In order to further secure cone adapter 80 and marker 10, an elongated rod 84 depends from the underside of the top of cone adapter 80, and therefore, is fixedly connected inside hollow interior 82. On the lower end of rod 84, there is a securing means, i.e., a barb 86 which is adapted for being engaged to the hole 20 of marker 10, thus facilitating a secured connection between marker 10 and cone adapter 80. Barb 86 is collapsible so that cone adapter 80 and marker 10 can be easily disengaged.

One advantage of using cone adapter 80, in conjunction with marker 10, is the capability of increasing the height of the overall traffic marker, which may prove desirable in certain traffic control situations.

FIG. 6 also illustrates a housing 88 located on the periphery of cone adapter 80, which is employed to dispense elongated strip of tape 90 therefrom. Housing 88 may be constructed in accordance with the embodiment of the present invention as shown in FIG. 5 (and accompanying text). Alternatively, FIG. 7 depicts a housing 88 which is disposed inside cone adapter 80, pursuant to the teachings of the invention as shown in FIGS. 1 & 2.

Figure 8:
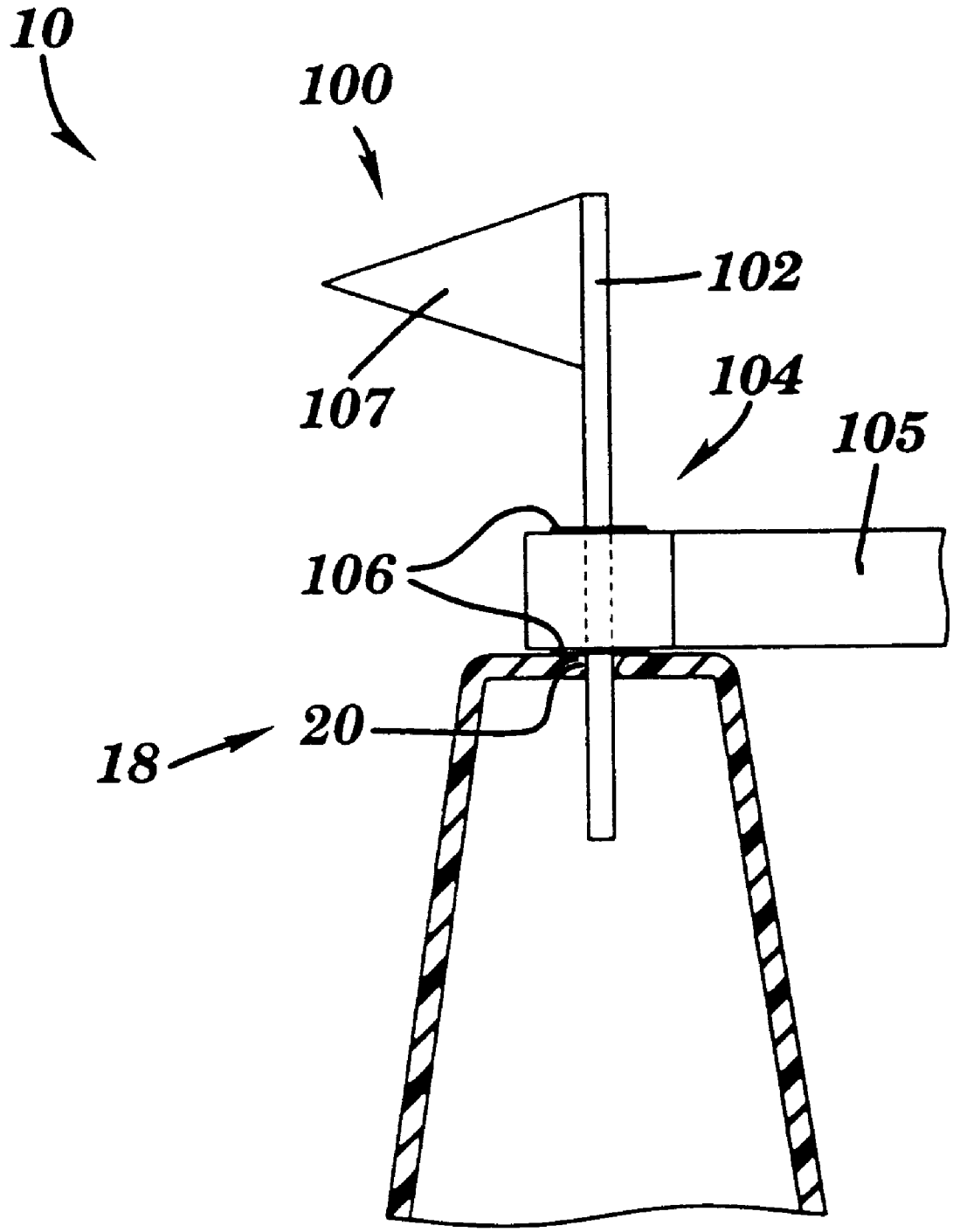
FIG. 8 is a side view of another embodiment of the subject invention, illustrating a rod adapter slidably inserted into the top hole of a traffic marker, wherein a tape dispenser or other tape dispensing housing is centrally attached to the rod for dispensing an elongated strip of tape therefrom.

FIG. 8 depicts yet another embodiment of an adapter, i.e., a rod adapter 100, which may be used for attachment to a conventional traffic marker, or to one of the traffic markers described herein, for dispensing an elongated strip of tape to create a continuous physical border between two or more locations.

Rod adapter 100 includes an elongated rod 102, one end of which may be slidably inserted into a hole 20 of marker 10. Preferably, hole 20 is tapered for accommodating rods of varying diameters. Rod adapter 100 has a tape dispenser 104 attached to rod 102. Preferably, tape dispenser 104 is attached to rod 102 at a central location. Means for attaching tape dispenser 104 to rod 102 may include two elastomeric "O" rings 106 each of which are peripherally attached to corresponding circumferential recesses formed in rod 102. At least one of the rings is adapted for easy removal, so that tape dispenser 104 can be easily removed and replaced. In the simplest sense, tape dispenser 104 is a roll of tape having a central core, which is slidably inserted onto rod 102. Alternatively, tape dispenser 104 may be a housing which includes an interior cavity (not shown) for holding an elongated strip of tape therein.

By inserting one end of rod 102 into marker hole 20, marker 10 may be converted into a marker having the capability of providing a strip of tape 105 for creating a physical barrier. As an option, a flag 107 may be secured to the upper end of rod 102.

Figure 9:
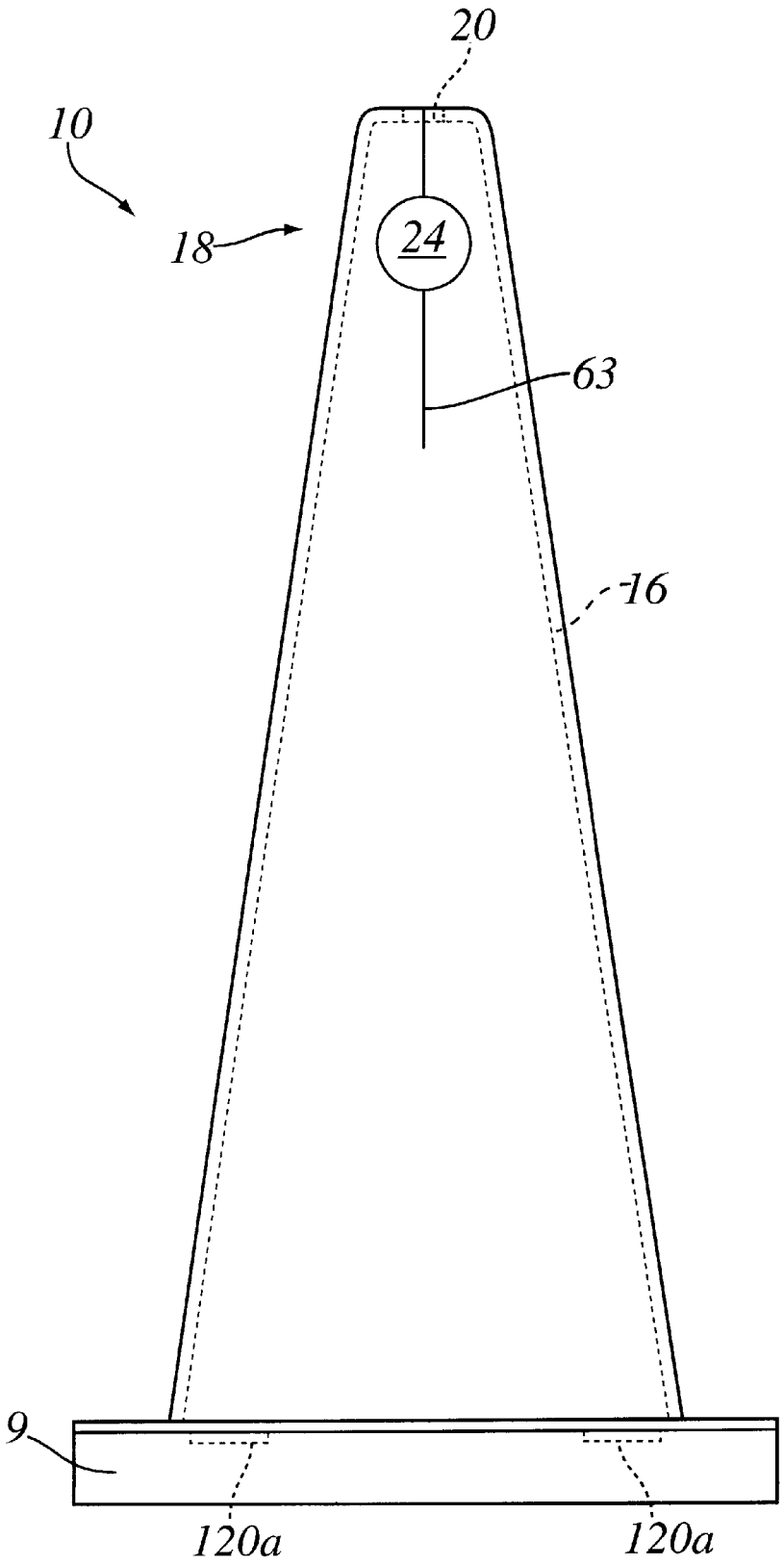
FIG. 9 is a side view of a traffic marker showing a circular opening formed therein for engaging a terminal end of an elongated strip of tape, or for passing an elongated strip of tape therethrough.

FIG. 9 depicts an embodiment of traffic marker 10 constructed in accordance with the principles of the present invention, but without the incorporation of a tape dispenser. As illustrated in FIG. 9, marker 10 can include one or more circular apertures 24 formed through sidewall 16. Preferably, two apertures 24 are aligned directly across from one another so that an elongated strip of tape can pass through both apertures, and therefore, through marker 10. While apertures 24 may be disposed anywhere on marker 10, preferably, apertures 24 are located in the region of upper portion 18. By forming one or more apertures 24 in upper portion 18, the tape can extend from or through the upper portion of marker 10, which facilitates ease of installation and visibility of the tape.

A terminal end of a strip of tape may include a rigid member, e.g., a rod or a handle (not shown), or other mechanical means for insertion into aperture 24 and for retention within aperture 24. The length of the rigid member should exceed the widest diameter of aperture 24. The resilient and deformable nature of marker 10 facilitates the ease of insertion and removal of the terminal end within aperture 24.

Figure 10:
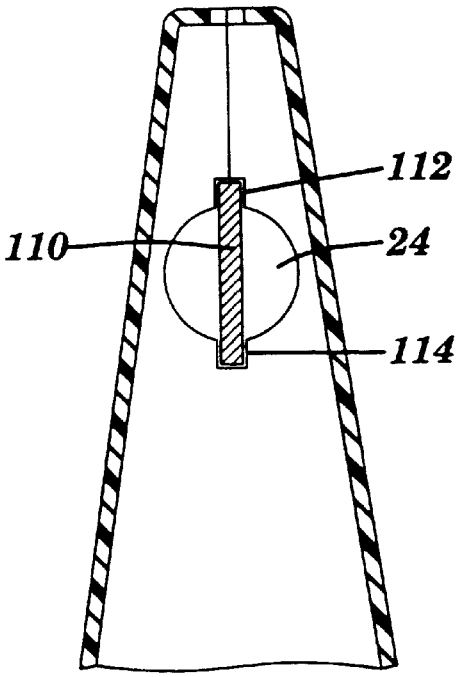
FIG. 10 is a partial side view showing an opening of a traffic marker configured with notches for receiving upper and lower edges of a sign therein.
Figure 11:
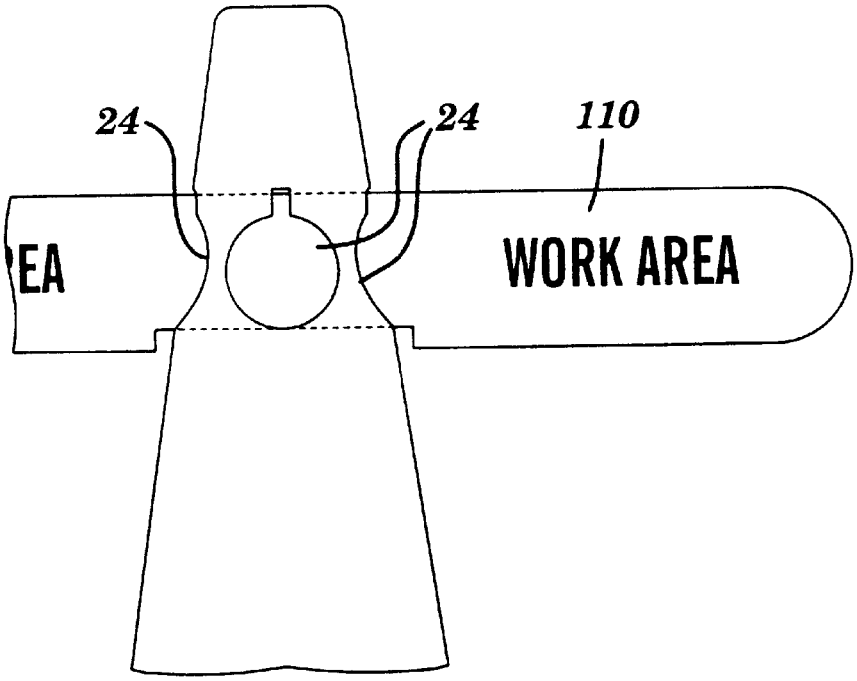
FIG. 11 is another partial side view depicting upper and lower edges of a sign inserted into a plurality of openings of the marker.
Figure 12:
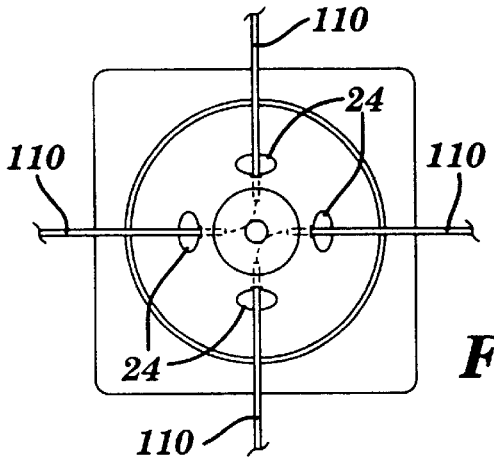
FIG. 12 is a top view illustrating four signs, each arranged in ninety degree relationship to one another, inserted into four openings of a marker.

As shown in FIGS. 10–12, one or more signs 110 may be removably incorporated into the apertures 24 formed on marker 10. FIG. 10 shows a sign 110 being engaged by an upper notch 112 and a lower notch 114 formed in the circumferential edge of aperture 24. These notches serve the purpose of holding the sign in its desired position, and for preventing rotation thereof. It is noted, however, that a single notch may be sufficient to hold the sign within aperture 24 (see FIG. 11). It is further noted that each notch may be uniquely configured in a key shape. FIG. 11 is a side view illustrating sign 110 passing through two oppositely and concentrically disposed apertures. FIG. 12 is a top view which illustrates four signs 110 each oriented in 90 degree relation to one another. As depicted, each sign may include a central bendable region. This bendable region permits a single sign to pass through two apertures 24 which are not concentrically aligned.

Sign 110 may be fabricated from a thin micro-hole material which permits wind to pass therethrough, thereby reducing resistance of the sign and marker and improving the stability of the sign and marker assembly. Sign 110 may also have a flexible frame which facilitates ease of use. In addition, sign 110 may include written messages and symbols thereon, e.g., "work area", "caution", ">>>>", etc.

Figure 13:
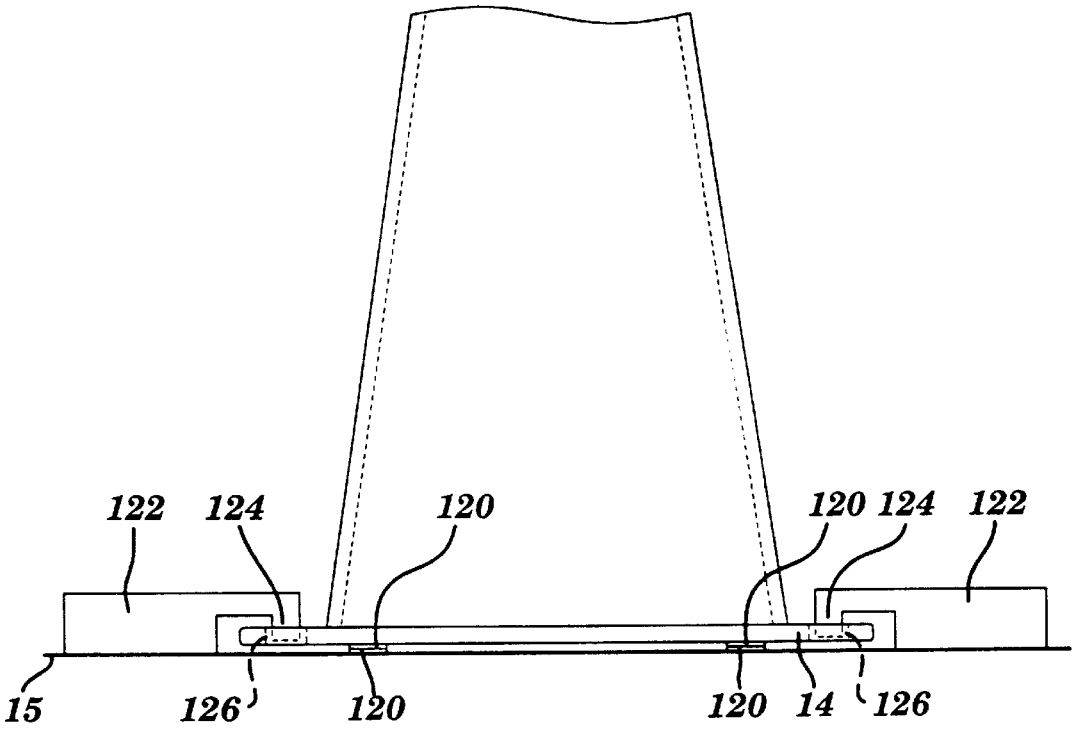
FIG. 13 is a partial side view illustrating another embodiment of the present invention, namely a means for maintaining the marker in an upright position.
Figure 14:
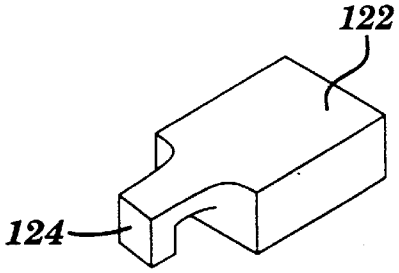
FIG. 14 is a perspective view depicting a hold-down weight constructed in accordance with the present invention.

FIGS. 13–14 illustrates another aspect of the present invention, i.e., a means for maintaining marker 10 in an upright position on surface 15. In one aspect of the invention, corresponding hook and loop fasteners (i.e., VELCRO) 120 can be employed to removably adhere the underside of base 14 of marker 10 to surface 15. After selecting the desired location, the worker can place the associated strips of VELCRO on the ground surface.

In another aspect of the invention, hold-down weights 122, having a hook member 124, can be employed to maintain marker 10 in an upright position on surface 15. Hook member 124 may engage either an aperture 126 formed through base 14 or a recess formed in base 14. A portion of hold-down weight 122 also engages surface 15 upon which marker 10 rests.

Figure 15:
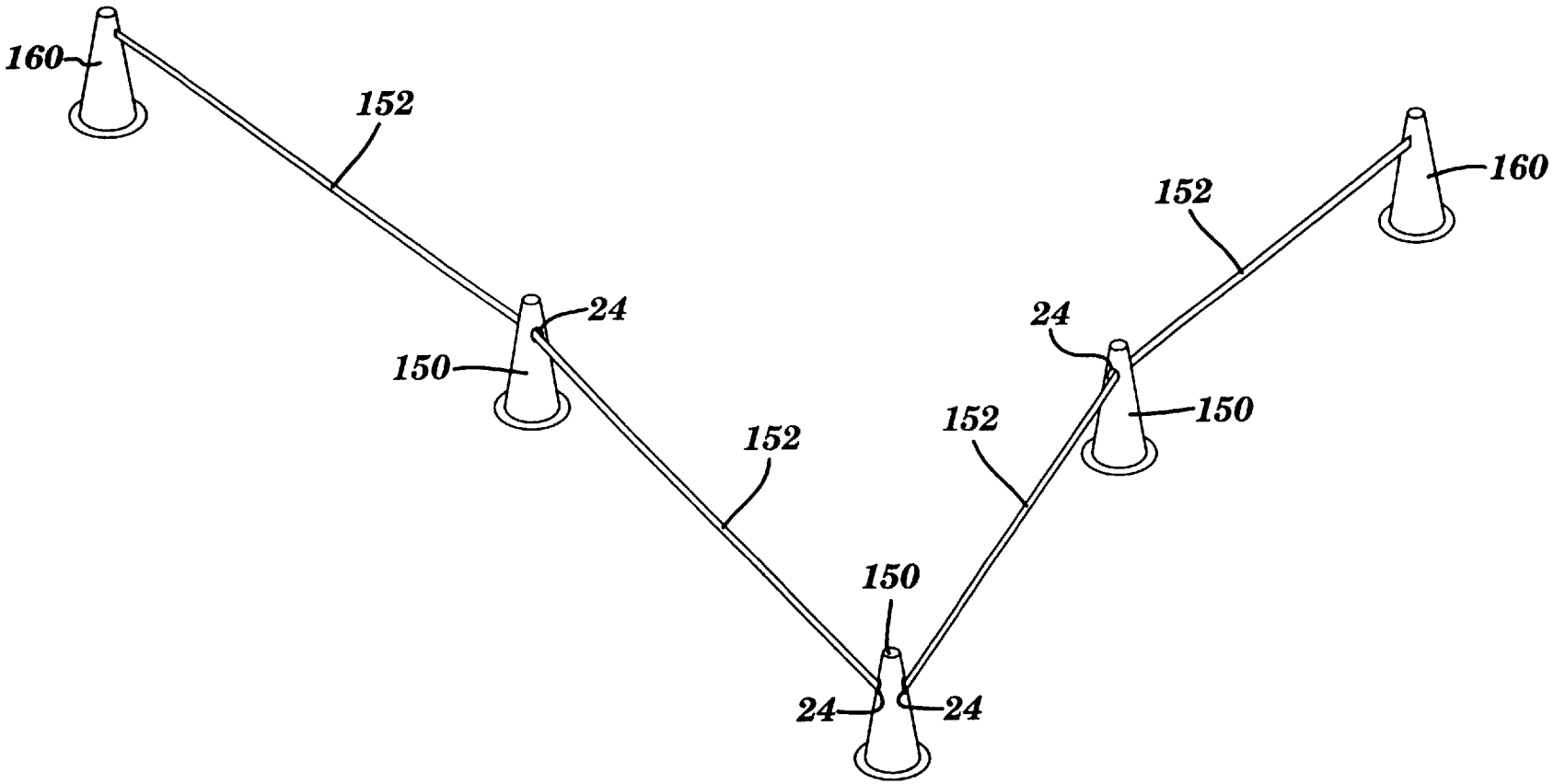
FIG. 15 is a system diagram illustrating a plurality of markers connected in accordance with the principles of the present invention so as to form a continuous border between the markers.

FIG. 15 is a system diagram illustrating a plurality of markers interconnected in accordance with the principles of the present invention. Intermediate markers 150 are simply cones having apertures 24 formed therethrough for the passing or connection of elongated strip of tape 152. The two outermost markers 160, include either a tape dispensing housing or one of the tape dispensing adapters described herein, and thus provides the source of tape 152. By employing the markers as defined herein, a plethora of different configurations can be achieved for any traffic control situation.

While several aspects of the present invention have been described and depicted herein, alternative aspects may be effected by those skilled in the art to accomplish the same objectives. For example, while the environment described above for the markers was land based, it is noted that the markers of the present invention can be used in an aquatic environment. In the aquatic environment, each of the markers would be adapted to float on the surface of the water, e.g., by using conventionally known floating means 9 (see FIG. 9) such as inflatable floating devices, float cushions, etc. attached to the flat base of marker 10 via connectors 120*a*. Accordingly, it is intended by the appended claims to cover all such alternative aspects as fall within the true spirit and scope of the invention.

What is claimed:

1. A portable safety marker comprising:

a base portion and an upper portion, wherein a central longitudinal axis extends from said base portion to said upper portion, said base portion configured for facilitating upright placement of said marker on a surface;

a sidewall extending upwardly from said base portion to said upper portion, said sidewall having an inner surface and an outer surface;

a hollow interior defined by said inner surface of said sidewall;

a housing disposed inside said hollow interior, wherein said housing is adapted for receiving a dispenser therein; said housing includes a rod for receiving an aperture of said dispenser; and an opening formed through said marker for dispensing an elongated safety material therethrough, wherein said upper portion of said marker is formed into first and second sections being separable from one another.

2. The portable safety marker of claim 1 wherein the dispenser includes a safety material dispenser.

3. The marker of claim 2, wherein said opening is formed through said sidewall.

4. The marker of claim 2, wherein said opening extends through a top of said marker, wherein said dispenser is receivable through said opening.

5. The marker of claim 2, wherein said housing includes a bottom wall, said bottom wall having the rod extending upwardly therefrom in a direction parallel to said central longitudinal axis of said marker.

6. The marker of claim 5, said rod being pivotally connected to said bottom wall such that said rod is variably pivotable to a position where a central longitudinal axis of said rod is oriented non-parallel to said central longitudinal axis of said marker.

7. The marker of claim 2, wherein said housing includes opposing end walls, each end wall having an aperture formed therein, said apertures being aligned coaxial to one another, each aperture being configured for receiving an end of the rod which receives said dispenser, wherein a central axis of said apertures is oriented substantially perpendicular to said central longitudinal axis of said marker.

8. The marker of claim 1, wherein said upper portion of said marker is operable between a closed position where said first and said second sections are engaged at said interface, and an opened position where said first and second sections are separated from one another, wherein when said upper portion is in said opened position, said dispenser may be placed in said housing.

9. The marker of claim 8, wherein said housing is formed into first and second parts, said parts being separable from one another at said interface, wherein said interface extends in a direction parallel to said longitudinal axis when said first and second parts are engaged together.

10. The marker of claim 8, wherein said first and second sections comprise equal portions.

11. The marker of claim 9, further comprising means for securing said first section and said second section in said closed position.

12. The marker of claim 11, wherein said securing means comprise latching fasteners.

13. The marker of claim 12, wherein said securing means comprise hook and loop fasteners.

14. The marker of claim 11, wherein said securing means comprises at least one magnet.

15. The marker of claim 2, wherein said opening comprises a first circular opening formed through said sidewall.

16. The marker of claim 15, further comprising a second circular opening formed through said sidewall, said second circular opening oriented across from said first circular opening.

17. The marker of claim 2, wherein said opening comprises a slit formed through said sidewall, said slit extending in a direction substantially parallel to said central longitudinal axis of said marker.

18. The marker of claim 17, wherein said slit includes non-straight edges.

19. The marker of claim 2, further comprising means for connecting a sign to said marker.

20. The marker of claim 19, wherein said connecting means comprises:

at least one circular opening formed through said sidewall, each opening having one or more notches formed on a circumference thereof for receiving an edge of a sign.

21. The marker of claim 19, further comprising two openings formed through said sidewall, said two openings being arranged non-concentric to one another, and a sign insertably received by said two openings, said sign having a bendable region so as to facilitate insertion of said sign through said two openings.

22. The marker of claim 2, further comprising means for maintaining said marker in an upright position on the surface.

23. A portable safety marker comprising:

a base portion and an upper portion, wherein a central longitudinal axis extends from said base portion to said upper portion, said base portion configured for facilitating upright placement of said marker on a surface;

a sidewall extending upwardly from said base portion to said upper portion, said sidewall having an inner surface and an outer surface;

a hollow interior defined by said inner surface of said sidewall;

a housing disposed inside said hollow interior, wherein said housing is adapted for receiving a dispenser therein;

an opening formed through said marker for dispensing an elongated safety material therethrough; and means for maintaining said marker in an upright position on the surface, wherein said upright position maintaining means comprises a fastener attached to an underside of said base portion.

24. The marker of claim 23, wherein said fastener comprises hook and loop fasteners.

25. The marker of claim 22, wherein said upright position maintaining means comprises:

an aperture extending through said base portion of said marker; and means for engaging said marker through said aperture and for engaging the surface upon which said marker rests.

26. The marker of claim 22, wherein said maintaining means comprises:

a recess formed in said base portion of said marker; and a weight having a first portion for engaging said recess of said marker and a second portion for engaging the surface upon which said marker is situated.

27. A portable safety marker fabricated from elastomeric material, said marker comprising:

a base portion and an upper portion, wherein said upper portion includes first and second sections, said first and second sections being separable from one another, and wherein a central longitudinal axis extends from said base portion to said upper portion, said base portion configured for facilitating upright placement of said marker on a surface;

a sidewall extending upwardly from said base portion to said upper portion, said sidewall having an inner surface and an outer surface;

a hollow interior defined by said inner surface of said sidewall, said hollow interior having a rod disposed therein for receiving an aperture of a safety material dispenser; and at least one opening formed through said sidewall for receiving one end of a safety material, said opening being bendable for facilitating insertion of said one end of said safety material therethrough.

28. The marker of claim 27, wherein said opening is a circular aperture formed through said sidewall.

29. The marker of claim 28, further comprising one or more notches formed in said circular aperture, wherein each notch is configured for receiving and holding an edge of a sign therein.

30. The marker of claim 28, wherein said marker includes a plurality of circular apertures, wherein at least two of said apertures are formed concentric to one another.

31. The marker of claim 30, further comprising one or more notches formed in each of said circular apertures, each of said one or more notches being configured for receiving and holding an edge of a sign therein.

32. The marker of claim 27, wherein said opening comprises a slit formed through said sidewall, said slit extending in a direction parallel to said central longitudinal axis of said marker.

33. The marker of claim 32, wherein said slit includes non-straight edges.

34. The marker of claim 32, wherein said slit includes upper and lower portions both formed perpendicular to said central longitudinal axis of said marker.

35. The marker of claim 27, further comprising a safety material dispenser disposed inside said hollow interior.

36. The marker of claim 35, further comprising a housing configured for removably receiving said safety material dispenser therein.

37. The marker of claim 27, further comprising means for floating said marker on a liquid.

38. The marker of claim 37, wherein said floating means comprises an inflatable float.

39. The marker of claim 37, wherein said floating means includes a connector for removably attaching said floating means to said marker.

* * * * *